US006604559B2

(12) United States Patent
Rubin

(10) Patent No.: US 6,604,559 B2
(45) Date of Patent: Aug. 12, 2003

(54) METHOD AND DEVICE FOR CUTTING A FLUID MATERIAL

(76) Inventor: Shlomo Rubin, 28475 Edgedale Rd., Pepper Pike, OH (US) 44124

( * ) Notice: Subject to any disclaimer, the term of this patent is extended or adjusted under 35 U.S.C. 154(b) by 0 days.

(21) Appl. No.: 09/903,419

(22) Filed: Jul. 11, 2001

(65) Prior Publication Data

US 2002/0074057 A1 Jun. 20, 2002

Related U.S. Application Data

(63) Continuation of application No. PCT/US00/00684, filed on Jan. 11, 2000.

(60) Provisional application No. 60/115,409, filed on Jan. 11, 1999.

(51) Int. Cl.[7] ..... B65B 1/04; B65B 3/04; B67C 3/02

(52) U.S. Cl. ..... 141/125; 141/18; 141/121; 99/537

(58) Field of Search ..... 141/18, 102, 105, 141/121, 125, 192; 426/637; 99/537; 56/12.7; 30/276

(56) References Cited

U.S. PATENT DOCUMENTS

| | | | | |
|---|---|---|---|---|
| 3,811,483 A | | 5/1974 | Morrison | |
| 3,822,623 A | | 7/1974 | Wight | |
| 3,831,278 A | | 8/1974 | Voglesonger | |
| 4,566,249 A | | 1/1986 | Schwerdtel et al. | |
| 4,729,413 A | | 3/1988 | Shults | |
| 5,095,687 A | * | 3/1992 | Andrew et al. | 56/12.7 |
| 5,102,599 A | | 4/1992 | Shults | |
| 5,797,516 A | | 8/1998 | Brandl | |
| 6,014,812 A | * | 1/2000 | Webster | 30/276 |
| 6,319,531 B1 | * | 11/2001 | Aichele et al. | 426/506 |

FOREIGN PATENT DOCUMENTS

| | | |
|---|---|---|
| EP | 640525 A1 | 8/1993 |
| FR | 2280554 | 7/1975 |
| GB | 1029300 | 5/1966 |

* cited by examiner

*Primary Examiner*—Timothy L. Maust
(74) *Attorney, Agent, or Firm*—Renner, Otto, Boisselle & Sklar, LLP

(57) ABSTRACT

A cutoff tool for severing a neck of a difficult-handling fluid material (a fluid material which is highly viscous, highly adhering, highly cohering, and/or shear thickening) includes a rotating whip, for example a string or a wire. The whip may be rotated at a sufficiently high rate, for example by a motor, so as to prevent adherence of the fluid material to the whip, for example by use of centrifugal forces to fling fluid material off of the whip. A system for filling containers includes a cutoff tool operatively coupled with a filling nozzle and a container clamp. A method of filling a container may include clamping the container, inserting a filling nozzle into the container, dispensing fluid material into the container, withdrawing the filling nozzle from the container during and/or after the filling, drawing back fluid material through the filling nozzle so as to thin a neck of fluid material between the filling nozzle and the filled container, and severing the neck, for example by using a cutoff tool.

16 Claims, 4 Drawing Sheets

METHOD AND DEVICE FOR CUTTING A FLUID MATERIAL

This application is a continuation of PCT/US00/00684, filed Jan. 11, 2000, which claims the benefit of U.S. Provisional Application No. 60/115,409, filed Jan. 11, 1999, both of which are incorporated herein by reference in their entireties.

TECHNICAL FIELD

The present invention relates generally, as indicated, to a cutoff tool for separation of fluid and method, and, more particularly, to an apparatus and method for cutting fluid-like materials and for filling containers for holding such fluid-like materials, and for use of such fluid-like materials in biomedical processes and the like.

BACKGROUND

In the past quantities of liquid of relatively low viscosity have been poured into containers, such as small vials, jars, test tubes, etc. If desired, those containers may be closed, capped or covered, etc., to retain the liquid therein for subsequent use. Relatively accurate quantities of such liquids may be measured so that the amount in each container is known.

Problems may arise in container filling due to characteristics of the filling fluid. For example, the filling fluid may be a highly viscous fluid and may exhibit high levels of adhesion (a tendency to stick to other materials) and/or cohesion (a tendency to remain stuck to itself and therefore not separate). In addition, the fluid may be shear thickening, exhibiting increasing viscosity as shear on the fluid is increased, and therefore becoming increasingly resistant to flowing as shear is increased. For instance, the fluid may have a consistency such as that of salt water taffy or some other material having one or more of the above characteristics. Exemplary fluids having at least some of the above characteristics have been used recently in biomedical processes, such as those related to DNA and/or to other processes. It is difficult to obtain relatively accurate quantities of such materials so that the amount in the container or to be processed is accurately known. It also is difficult to separate a quantity of such material from the bulk of such material. Frequently such material cannot be poured or if it is able to be poured, the speed at which it is poured is extremely slow, such pouring perhaps being time intensive, expensive, and/or tedious. Sometimes a cutting tool, such as a knife, blade or scissors is used to cut a portion of the fluid material from a bulk or other supply thereof. This may be the case when the portion is cut from a large bulk mass or even when the portion is cut from a pulled relatively thin cross-sectional string or somewhat or generally cylindrical-shape amount of the fluid material.

One disadvantage of trying to move a blade or the like through fluid material is the relatively large amount of force that may be required and the time and machinery required to apply such force. Another disadvantage to moving a blade or the like through the fluid material is the adherence of the material to the blade, especially if the fluid material is sticky (highly adhering). The cutting tool may require frequent cleaning to remove accumulation of the fluid material that has stuck thereto. Such accumulation of fluid material on the cutting tool may be particularly rapid where the fluid is cohesive, being highly self adhering. Also, as the material sticks to the cutting tool, the force and work required to move the cutting tool through the material further increases.

In the field of biomedical engineering and biotechnology, some materials that are used have one or more characteristics of those described above. That is, the fluid material may be highly viscous, highly adhering, highly cohering, and/or shear thickening, such fluid materials referred to hereafter for brevity's sake as "difficult-handling fluid materials." It is desirable to be able to accurately and efficiently to package such difficult-handling fluid materials for use in various biomedical processes and the like. Accuracy of the packaging process and/or accuracy of the process of obtaining a defined quantity of such material, whether packaged or not, for example, in a continuous process or operation using such material, is costly when taking substantial time for each cutting or separating of a quantity of the material from a larger quantity. It also is costly and wasteful to have to clean the equipment on a frequent basis when the fluid material sticks to the cutting tool or instrument; it also is costly, and usually disadvantageous, in the event the incorrect amount of material is used in the course of a downstream process which uses the material.

Accordingly, there is strong need in the art to facilitate cutting difficult-handling fluid materials. There also is a strong need in the art to be able relatively accurately to cut defined quantities of such fluid material from a bulk quantity thereof, regardless of the form of the bulk quantity, and there is a further need to be able to package, for example, by filling a container, such fluid material.

SUMMARY OF THE INVENTION

With the foregoing in mind, then, one aspect of the invention is to facilitate cutting a difficult-handling fluid material.

Another aspect is to cut a difficult-handling fluid material without having the material stick to the cutting instrument or at least to minimize or to reduce the amount of such fluid material that sticks to the cutting tool or instrument.

A further aspect is to cut a defined quantity of a difficult-handling fluid material from a bulk.

Another aspect is to package defined quantities of difficult-handling fluid material in containers, such as vials, bottles, jars, etc.

Another aspect is to increase the speed with which difficult-handling fluid material can be cut from a larger quantity of difficult-handling fluid material.

Another aspect is to combine a cutoff tool with a process for a difficult-handling fluid material and a filling apparatus, to fill a container with a relatively accurate quantity of the difficult-handling fluid material.

Another aspect is to operate such a cutoff tool and filling machine substantially automatically.

Another aspect is to facilitate cutting quantities of difficult-handling fluid material while holding a cutoff tool by hand.

Another aspect is to facilitate the packaging of biomedical material having characteristics such as being highly viscous, highly adhering, highly cohering, and/or shear thickening.

Another aspect relates to a cutoff tool for cutting difficult-handling fluid material comprising a string or whip having relatively small surface area, and means for rotating the string or whip at relatively high velocity to cut the difficult-handling fluid material without substantial sticking to the string or whip.

Another aspect relates to a method of cutting difficult-handling fluid material comprising rapidly moving a relatively small surface area material, such as a string, wire, whip or the like through the material to cut the same without substantial sticking of the material to the string or whip.

Another aspect relates to a filling machine for filling containers with prescribed quantities of difficult-handling fluid material, comprising a conveyor for moving containers past a filling station, a supply of difficult-handling fluid material, and a cutoff tool hereof.

Another aspect relates to a method of filling containers with a quantity of difficult-handling fluid material, comprising the steps of conveying a container to an area where the container is to be filled, providing a quantity of difficult-handling material, and cutting a prescribed quantity of the difficult-handling fluid material from the supply thereof using the method hereof.

Another aspect relates to a biomedical process apparatus, comprising a biomedical apparatus, a supply of difficult-handling fluid material used in the biomedical process apparatus, and a cutoff apparatus in accordance herewith for putting a prescribed quantity of difficult-handling fluid material for use in the biomedical process apparatus.

Another aspect relates to a method of biomedical processing of difficult-handling fluid material, comprising providing a supply of difficult-handling fluid material, using the methods hereof to cut off a prescribed quantity of difficult-handling fluid material, and biomedically processing the difficult-handling fluid material cut off from the supply to provide an output material for use in biotechnology or other purpose.

According to yet another aspect of the invention, a device for cutting a fluid material includes a cutting whip which rotates at at least 8000 rpm; and a motor operatively coupled to the whip to rotate the whip.

According to a further aspect of the invention, a system for at least partially filling a container with a fluid material includes a clamp operationally configured to hold the container; a nozzle operatively coupled to a supply of the fluid material, the nozzle operationally configured to dispense the fluid material into the container; and the cutting device operationally configured to cut a neck of the fluid material between the nozzle and the fluid material in the container.

According to a still further aspect of the invention, a method of at least partially filling a container with a fluid material, includes securing the container in a clamp; dispensing the fluid material into the container through a nozzle; and cutting a neck of the fluid material between the nozzle and the fluid material in the container.

To the accomplishment of the foregoing and related ends, the invention, then, comprises the features hereinafter fully described in the specification and/or particularly pointed out in the claims, if appended hereto, the following description and the annexed drawings setting forth in detail certain illustrative embodiments of the invention, these being indicative, however, of but several of the various ways in which the principles of the invention may be suitably employed.

Although the invention is shown and described with respect to one or more preferred embodiments, it is obvious that equivalents and modifications will occur to others skilled in the art upon the reading and understanding of the specification. The present invention includes all such equivalents and modifications, and is limited only by the scope of the claims.

DETAILED DESCRIPTION

Figure 1:
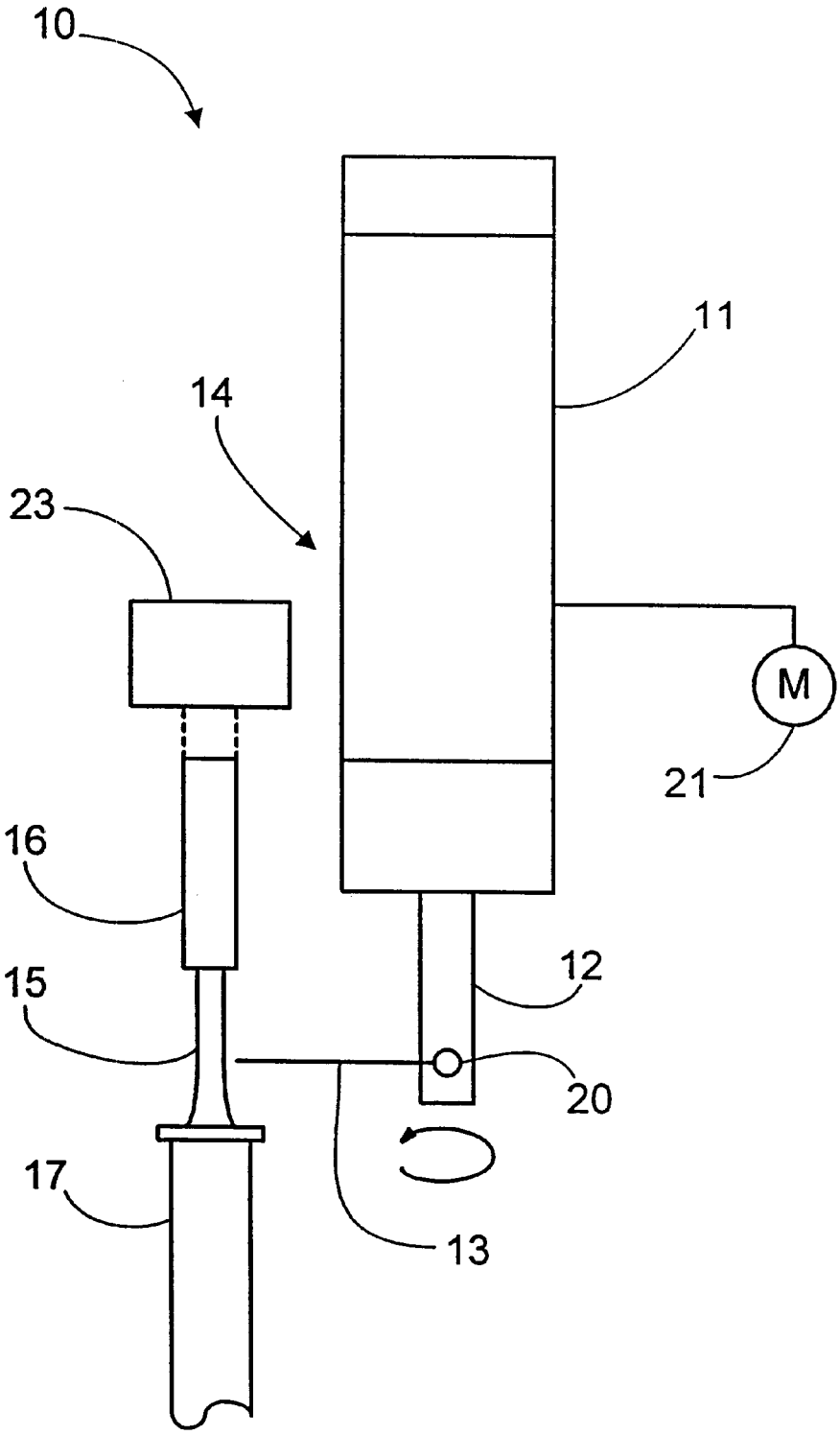
FIG. 1 is a schematic illustration of a cutoff tool for separation of difficult-handling fluid according to an embodiment of the invention.

Referring in detail to the drawings, wherein like reference numerals designate like parts in the several figures, and initially the FIG. 1, a cutoff tool for separation of difficult-handling fluid is illustrated at 10. As noted above the term "difficult-handling fluid material" refers to a fluid material that is highly viscous, highly adhering, highly cohering, and/or shear thickening. It will be appreciated that the terms "fluid" or "fluid material," as used herein, include liquids as well as liquid-like materials such as colloids having a liquid continuous phase (gels, emulsions, foams, and various combinations thereof).

The cutoff tool includes an air motor 11, a rotating shaft 12, and a cutting string 13 (sometimes referred to as a wire or a whip). The air motor 11 is mounted in a housing 14 and the shaft 12 is the output shaft of the motor or is coupled to the output shaft of the motor and extends outside the housing to expose the string 13 for use to cut difficult-handling fluid material 15 from a bulk source 16 thereof. The cut material 15 drops into a container 17, such as a vial, test tube, beaker, bottle, jar, etc. The vial 17 may be covered or capped to retain the quantity 15*a* of difficult-handling fluid therein and preferably also to prevent contamination of such material therein.

The string 13 may be, for example, a wire material. Exemplary wire material may be stainless steel. The material may be bronze or nylon. The string 13 may be another non-contaminating material, i.e., another material that does not contaminate the difficult-handling fluid material 15 when cutting that material. The string 13 may be a fabric string that does not contaminate or it may be some other material, as may be desired. Other exemplary materials are polymers, metals, plastics, etc. An exemplary wire string 13 is stainless steel having a gauge of 0.025".

The air motor 11 may be, for example, a conventional air motor that has a relatively high revolutions per minute rating able to rotate the string or wire 13 relatively rapidly. An exemplary speed is 22,000 revolutions per minute. Other speeds which work to carry out the desired cutting functions with relatively minimal sticking of the material 15 to the string may be used. Other types of motors may be used for this purpose to rotate the string 13 at a sufficiently high speed to effect the desired cutting.

The string 13 is attached to the shaft 12, for example, at an eyelet 20 by tying to the eyelet, or by some other fastener mechanism attaching to the eyelet, etc. Alternatively, the string 13 may otherwise be fastened to the shaft 12. Still further, if desired, the string 13 may be a fixed length string or it may be a string that is of variable length, being fed from a supply thereof contained in the housing 14 or elsewhere. Such supply may be operated manually or automatically to maintain the length of the string and/or, for example, to supply new lengths of string while cutting off or allowing for cutting the old lengths as may be desired.

A motor 21 may be operated by a switch or otherwise to move the cutoff tool 10 toward or away from the difficult-handling fluid 15 thereby to cause the string 13 to engage the difficult-handling fluid 15 at the area 22 or to move the string 13 away from the difficult-handling fluid. The motor may be operated so that the cutoff tool automatically cuts approximately the same size quantity of difficult-handling fluid 15 from the bulk 16. In such case, the motor 21 is operated to move the cutoff tool 10 toward the difficult-handling fluid when a prescribed quantity of a difficult-handling fluid 15 has been extruded or otherwise delivered from the bulk 16 thereof toward or into the vial 17, thereby to cut the difficult-handling fluid at the area 15 thereof so that a prescribed amount enters the vial 17 for storage therein and subsequent use. Thereafter the motor 21 operates the cutoff tool 10 to move it away from the difficult-handling fluid until another known quantity or amount of difficult-handling fluid is discharged from the bulk 16 thereof toward or into another vial 17, and then the motor 21 again moves the tool 10 toward the fluid 15 to cut the next portion thereof, and so forth.

Alternatively, the cutoff tool 10 may be operated manually to move the tool toward or away from the difficult-handling fluid. Still further, if desired the tool may be maintained in a fixed location and simply the string 13 may be extended or withdrawn into the tool as respectively to cut the difficult-handling fluid or to withdraw from it while additional difficult-handling fluid is dispensed from the bulk 16 thereof.

The string 13 is of a wire or other material may advantageously have sufficiently small gauge and sufficient strength to effect efficient cutting of the difficult-handling fluid as the wire is spun by the rotating shaft 12 and air motor 11. The string 13 should have sufficient strength as not to break readily. Also, the string 13 may be of sufficiently small cross-section so that the difficult-handling fluid material 15 does not stick thereto. In particular, the difficult-handling fluid material tends not to stick to the wire 13 because of the very small surface area thereof and because of the centrifugal force (or force of rotation) created by the rotation of the air motor 11, shaft 12 and string 13, which may fling fluid material from the string.

The cutoff tool may be mounted for use in an automatic machine or may be held manually and used in the manual mode, e.g., as a hand tool.

Although the motor 11 is described as an air motor, it will be appreciated that an electric motor, hydraulic motor, or some other type of motor may be used.

Figure 2:
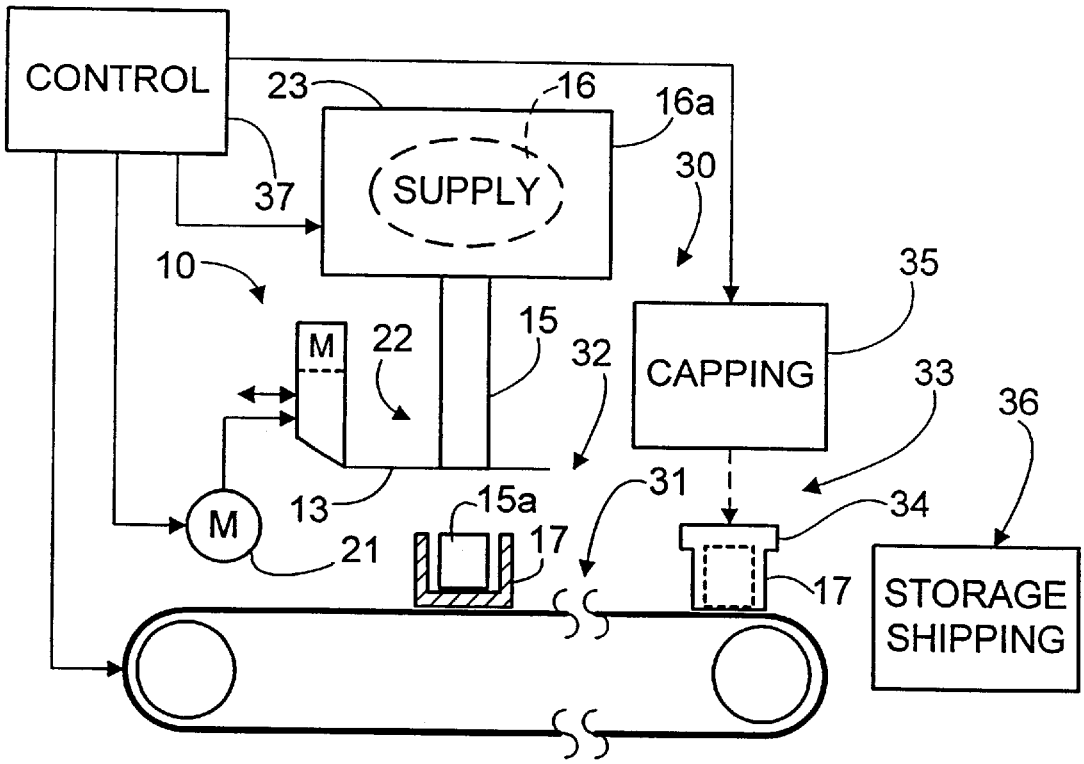
FIG. 2 is a schematic illustration of a cutoff tool used in combination with a filling apparatus for difficult-handling fluid.

Turning now to FIG. 2, an automatic packaging apparatus 30 is shown. The apparatus 30 includes a cutoff tool 10 positioned relative to a supply 16*a* of difficult-handling fluid 16. The difficult-handling fluid is extruded or otherwise dispensed from the supply 16*a* and a quantity 15 thereof is shown extending from the supply 16*a*. The string 13 is used to cut a quantity of the material 15*a* and to allow such cutoff quantity to drop into a vial 17. The vial 17 is carried on a conveyor 31. Down stream of the dispensing location 32, the conveyor 31 carries the vials 17 to a capping station 33 where a cap 34 is applied to the vial 17 by a conventional capping tool or apparatus 35. The capped vials 17 then are sent to a storage or shipping location or apparatus 36 where they are stored or from where they are shipped for eventual use of the difficult-handling material therein. The motor 21 may be coordinated, e.g., by a computer 37, with operation of the conveyor 31 in the apparatus 30 along with the coordination of operation of the dispensing mechanism in the supply 16*a* so that prescribed quantities of the difficult-handling fluid 15*a* are dispensed properly into respective vials or other containers 17.

Figure 3:
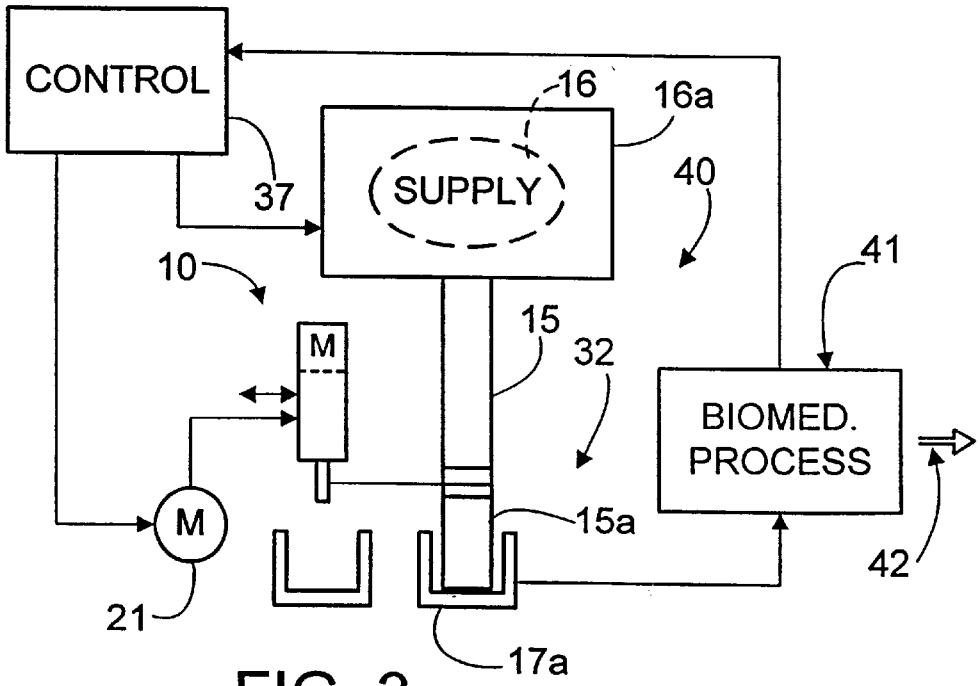
FIG. 3 is a schematic illustration of a cutoff tool used in combination with a biomedical processing apparatus.

Briefly referring to FIG. 3, a biomedical processing apparatus 40 is shown. The apparatus 40 includes a supply 16*a* of difficult-handling material 16 which is dispensed into containers 17*a* into which other ingredients may be applied. The containers 17*a* then may be delivered to a biomedical process oven, mixing apparatus, or other ingredient-adding, processing, etc. system 41. The output 42 from the system 41 is represented by an arrow designating the delivery of the intermediate or final product obtained by processing of the difficult-handling fluid alone and/or with other ingredients, etc. A control 43, such as a computer control like that shown at 37 in FIG. 2, for example, controls dispensing of the difficult-handling fluid materials 16 from the supply 16*a*, and controls operation of the cutoff tool 10 and the motor 21 associated therewith and receives feedback information from the biomedical system 41 to coordinate operation of those components of the apparatus 40 to provide prescribed quantities 15*a* of difficult-handling fluid to obtain a desired output material 42.

Thus it will be appreciated that the cutoff tool 10 may be used to cut off quantities of the difficult-handling fluid material using not only a manual technique but also using automatic techniques in association with processes that may use the difficult-handling fluid material.

What follows now are alternate embodiments of the invention. The details of certain common similar features between the alternate embodiments and the embodiment or embodiments described above are omitted in the description of the alternate embodiments for the sake of brevity. It will be appreciated that features of the various alternate embodiments may be combined with one another and may be combined with features of the embodiment or embodiments described above.

Figure 4:
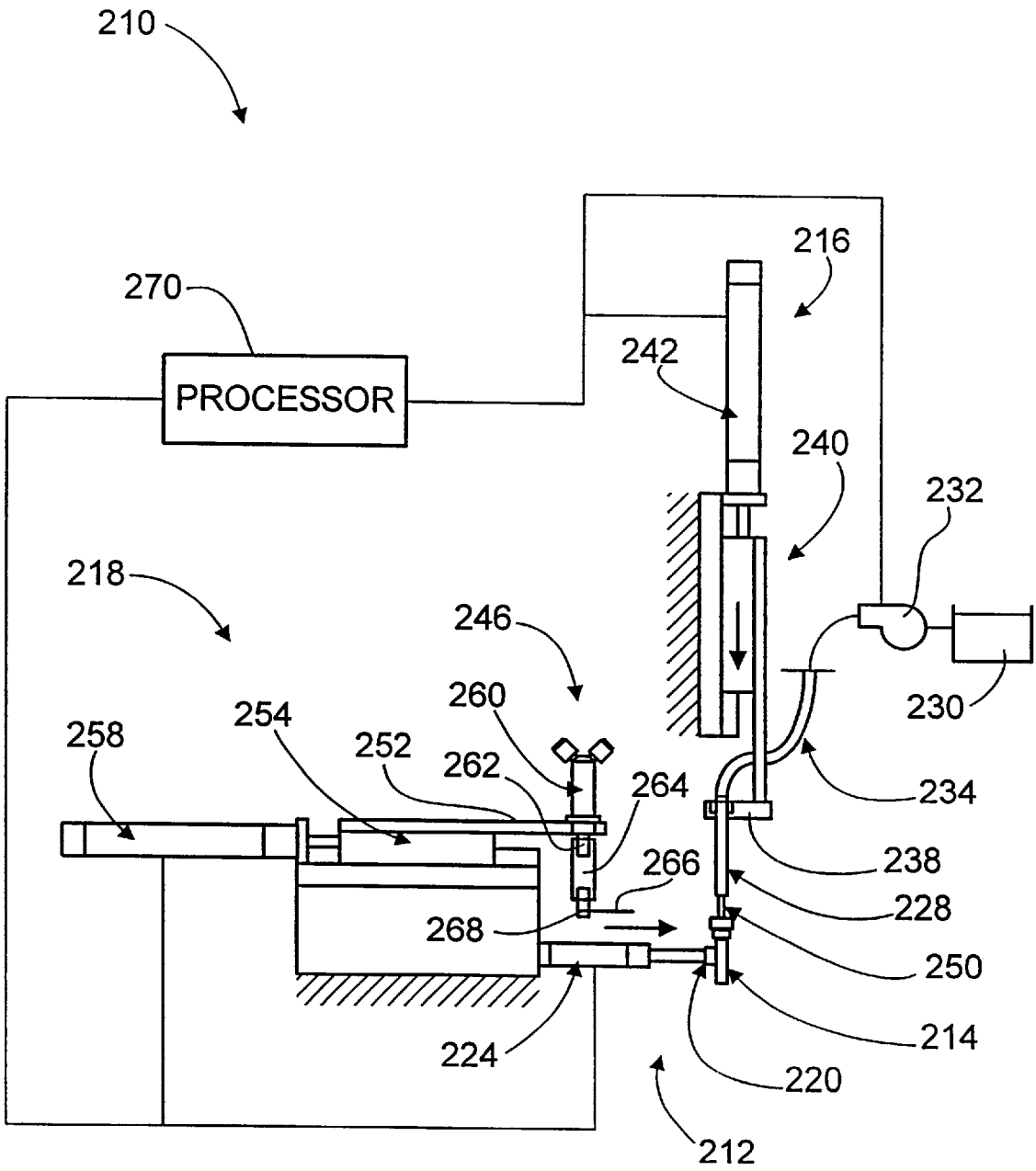
FIG. 4 is an illustration of a system for filling a container with a difficult-handling fluid material, in accordance with an alternate embodiment of the invention.

Referring now to FIG. 4, a system 210 is shown for filling containers such as vials with a difficult-handling fluid or fluid material. The system 210 includes a holding and positioning device 212 for securing and positioning a container or vial 214, a fluid dispenser 216 for dispensing the difficult-handling fluid into the container 214, and a severing device 218 for severing a filament or neck of the fluid material which remains between the container 214 and the fluid dispenser 216 after dispensing of the fluid into the container.

The holding and positioning device 212 includes a clamp 220 for securing the container 214 and a clamp movement device 224. The clamp 220 utilizes well-known clamping design(s), for example having two opposed grips which clamp the container 214 between them. The clamp 220 serves to hold the container 214 in place during the filling operation. Since the difficult-handling fluid material may be highly cohesive, it is advantageous to hold the container 214 securely in place by use of the clamp 220, thereby preventing the cohesive forces within the highly-cohesive difficult-handling fluid material from pulling the container upward toward the fluid dispenser 216 as the fluid dispenser is moved away from the holding and positioning device 212. Such pulling may be likely to occur after filling, yet before cutting off of the connection between the fluid dispenser 216 and the container 214. It will be appreciated that the term "clamp," as used herein, includes a wide variety of suitable hold-down mechanisms for securing the container.

The clamp movement device 224 may be an air cylinder or other linear actuator, and may be used to accurately position the clamp 220 and therefore the container 214 relative to the fluid dispenser 216. It will be appreciated that the movement device 224 may be one of a wide variety of suitable devices for positioning the clamp 220 in the container 214. For example, a suitable sliding mechanism may alternatively be used to position the clamp 220 and the container 214. It will further be appreciated that suitable movement devices may be used for positioning the clamp 220 in the container 214 in two or three dimensions.

The fluid dispenser 216 includes a filling nozzle 228 for dispensing the difficult-handling fluid or fluid material. The filling nozzle 228 may be, for example, a stainless steel tube such as a hollow needle. Fluid material for filling the container 214 is maintained in a fluid material supply 230. A metering device or pump 232 withdraws material from the fluid material supply 230 and sends it to the filling nozzle 228 via flexible tubing 234. The filling nozzle 228 is connected to a nozzle bracket 238, which in turn is coupled to a nozzle slide mechanism 240 for vertically positioning the filling nozzle 228. A nozzle movement device 242, such as an air cylinder or other linear actuator, controls the vertical position of the nozzle slide mechanism 240, and thus the vertical position of the nozzle bracket 238. As described in greater detail below, the nozzle 228 is inserted in the container or vial 214 during all or part of the dispensing of fluid into the container 214. During or after dispensing of the fluid to fill the container 214, the filling nozzle 228 is moved vertically upward out of the container. A cutoff tool or cutting device 246 thereafter used to sever a filament or neck of remaining fluid in a space 250 between the filling nozzle 228 and the container 214.

The severing device 218 includes the cutoff tool 246, as well as a cutoff tool bracket 252 for securing the cutoff tool 246 relative to a cutoff tool slide mechanism 254. The cutoff tool slide mechanism 254 allows horizontal movement of the cutoff tool 246, the position of the cutoff tool being controlled by a cutoff tool movement device 258, which may be an air cylinder or other type of linear actuator.

The cutoff tool 246 includes a motor 260, for example an air motor driven by pressurized air. The motor 260 has a shaft 262 which is coupled to a shaft extension 264. A whip 266 is connected to the shaft extension 264 via a whip-extension connection 268. The extension 268 may be, for example, an eyelet. It will be appreciated that other suitable connections between the whip 266 and the shaft extension 264 may alternatively be employed, such as by directly coupling the whip to the motor shaft.

The whip 266 may be made of a material such as those described above with regard to the string or whip 13. Thus the whip 266 may be made of a polymer material such as nylon, or may be made of a metallic material such as stainless steel, bronze, or another suitable metal or alloy. An exemplary material for the whip is 60-pound ocean fishing line. More broadly, the whip 266 may be made from a wide variety of suitable metallic and nonmetallic materials. It may be advantageous to have the whip 266 made of a flexible material. However, if desired the whip 266 may be made of a non-flexible material. It is desirable for the whip 266 to be made of a strong material that will withstand, without breaking, the high-speed rotation of the whip 266 by the motor 260, and the severing of a neck or filament of the fluid material while the whip 266 is being so spun.

In order to prevent adherence of the fluid material to the whip 266, it is advantageous for the whip to have a small cross-sectional area. Thus the whip may have a circular cross-section, and may have a diameter of approximately 0.025 inches, may have a diameter of no more than 0.030 inches, or may have a diameter of approximately 0.028–0.030 inches. The whip 226 may be about 1.0 inch long, or may be between about 1.0 and 4.0 inches long. It will be understood that the foregoing values are only exemplary, and that the whip 266 may have other diameters and/or lengths.

It is advantageous for the motor 260 to rotate the whip 266 at a high enough rate such that centrifugal forces will fling off of the whip any of the fluid material which would otherwise adhere to the whip due to the whip being used to sever the filament or neck of material between the fluid dispenser 216 and the container or vial 214. Accordingly, the whip may be rotated at at least 8,000 rpm, may be rotated at at least 10,000 rpm, may be rotated at at least 15,000 rpm, may be rotated at at least 20,000 rpm, may be rotated at at least 22,000 rpm, or may be rotated at approximately 22,000 rpm.

The system 210 may include a processor 270 for controlling the operation of the various moving parts of the system 210. The processor 270 may be, for example, any of a wide variety of suitable computer processors. The processor 270 may be operatively coupled to the clamp movement device 224, the metering device 232, the nozzle movement device 242, the cutoff tool movement device 258, and/or the motor 260. Thus the processor 270 may control actuation of the movement devices flow of the fluid material through the metering device 232, and/or switching and/or speed control of the motor 260. It will be appreciated that multiple processors may be utilized, if desired.

It will be appreciated that a system similar to the system 210 may be utilized having multiple nozzles, clamps, and/or cutoff tools, so as to allow multiple containers to be filled simultaneously or in rapid sequence. Well known methods and/or devices may be used to automatically or otherwise move additional empty containers or vials into place for filling, and/or to remove filled containers or vials from the system 210.

Figure 5:
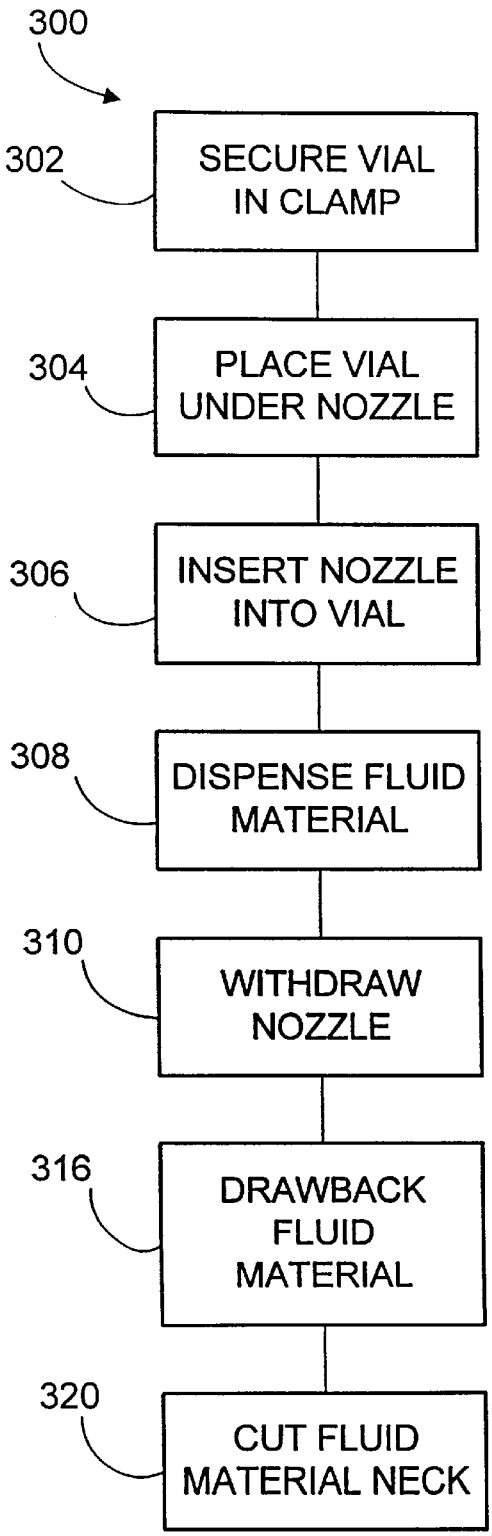
FIG. 5 is a flow chart illustrating the steps of a filling method utilizing the system of FIG. 4.

Referring now to FIG. 5, a flow chart is shown of the steps of a method 300 for using the system 210 for filling a container or vial 214. In step 302 the container or vial 214 is secured in clamp 220. In step 304, the container or vial 214 is placed beneath the filling nozzle 228. It will be appreciated that the steps 302 and 304 may be performed in opposite order, or may be combined into a single step, the operations of both steps being performed simultaneously.

Figure 6:
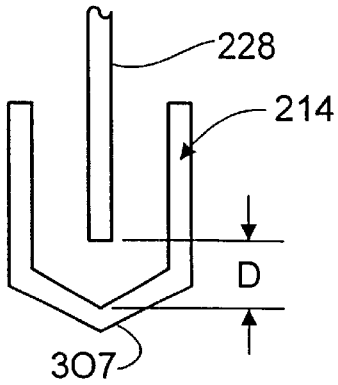
FIGS. 6 and 7 are illustrations of selected filling steps of the method of FIG. 5.

Thereafter the filling nozzle 228 is lowered into the vial 214, in step 306, as illustrated in FIG. 6. The filling nozzle 228 is inserted into the vial 214 until it reaches a distance D above a bottom surface 307 of the vial 214. The distance D is selected such that the difficult-handling fluid material dispensed into the vial 214 adheres to the bottom surface 307 of the vial. Adherence of the fluid material to the bottom and sides of the vial 214 may be a problem when the fluid material has a cohesiveness that is greater than its adhesiveness. This may be the case even for a highly adhesive (sticky) fluid material. In step 308 the metering device or pump 232 is activated to dispense a measured quantity of the difficult-handling fluid material into the vial 214 via the filling nozzle 228.

Figure 7:
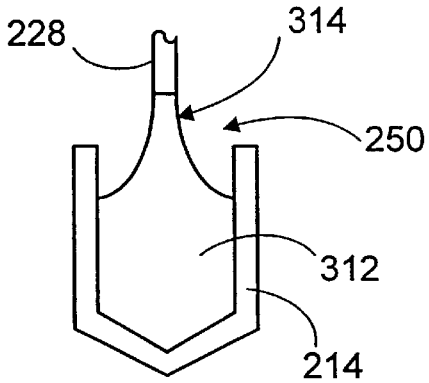

During and/or after the dispensing of the fluid material into the vial 214, the nozzle 228 is withdrawn from the container or vial 214, in step 310. The result of steps 308 and 310 is illustrated in FIG. 7. The space 250 between the filling nozzle 228 and the top of the vial 214 may be, for example, 0.25–0.50 inches. There it may be seen that a metered amount 312 of the difficult-handling fluid material is in the vial 214. Due to the characteristics of the difficult-handling fluid material, a neck or filament 314 of the fluid material is formed between the nozzle 228 and the metered amount 312. The characteristics of the difficult-handling fluid may be such that the neck 314 will not become severed on its own within a reasonable period of time. Accordingly the severing device 218 is used as described below to sever the neck 314. However, before severing, in step 316 fluid is drawn back through the nozzle 228 to thin the neck 314, thereby making the neck easier to cut.

Figure 8:
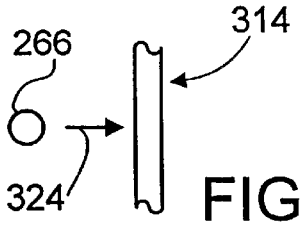
FIGS. 8–10 are schematic illustrations of the process of severing a neck of difficult-handling fluid material.
Figure 9:
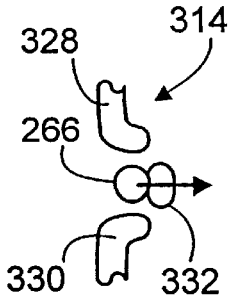
Figure 10:
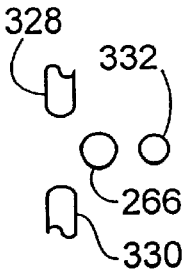

The neck is then cut in step 320. The step 320 may involve a number of substeps. For example, the motor 260 may be turned on, the cutting device or cutoff tool 246 may be horizontally brought toward the neck 314, and the rapidly-rotating whip 266 may be used to sever the neck 314. The severing of the neck 314 by the whip 266 is schematically illustrated in FIGS. 8–10. In FIG. 8, the whip 266 is shown approaching the neck 314, the direction of movement of the whip 266 being indicated by arrow 324.

In FIG. 9 the whip 266 contacts the neck 314. The whip 266 hits the neck 314 with sufficient force so as to separate the neck 314 into an upper portion 328 and a lower portion 330. A central portion 332 of the neck 314 is separated from the portions 328 and 330, the central portion 332 traveling along with the whip 266. It is expected that the portions 328 and 330 undergo some deformation, the fluid material in them closest to the whip 266 being pulled somewhat in the direction of movement of the whip. However, the neck 314 and the whip 266 and its movement are such that the deformed parts of the portions 328 and 330 do not have sufficient momentum to pull them away from the filling nozzle 228 and the vial 214, respectively. It will be appreciated that the thinning of the neck 314 previously performed in the step 316 may advantageously increase the tension forces in the neck 314 tending to pull the respective portions 328 and 330 back toward the nozzle 228, and the toward bulk material 312 in the vial 214. It will further be appreciated that the thinning of the neck 314 may leave an insufficient amount of material for the deformation of the lower portion 330, for example, to spill over the side of the container 214.

Referring now to FIG. 10, the whip 266 preferably has characteristics such that and/or is moving at a speed such that the central portion 332 of material is flung off the whip 266. The characteristics of the whip 266 which may cause and/or enhance this flinging may also include the cross-sectional area of the whip and/or the material of the whip.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A system for at least partially filling a container with a fluid material, comprising:

a clamp operationally configured to hold the container;

a nozzle operatively coupled to a supply of the fluid material, the nozzle operationally configured to dispense the fluid material into the container; and the cutoff device operationally configured to cut a neck of the fluid material between the nozzle and the fluid material in the container;

wherein the cutoff device includes:

a cutting whip which rotates at at least 8000 rpm; and a motor operatively coupled to the whip to rotate the whip.

2. The device of claim 1, wherein the whip rotates at at least 10,000 rpm.

3. The device of claim 1, wherein the whip rotates at at least 15,000 rpm.

4. The device of claim 1, wherein the whip rotates at at least 20,000 rpm.

5. The device of claim 1, wherein the whip rotates at at least 22,000 rpm.

6. The device of claim 1, wherein the whip includes a string of polymer material.

7. The device of claim 6, wherein the string of polymer material is a length of fishing line.

8. The device of claim 1, wherein the whip has a diameter of 0.028 to 0.030 inches.

9. The device of claim 1, wherein the motor is an air motor.

10. The system of claim 1, wherein the cutoff device is horizontally movable relative to the nozzle and/or the clamp.

11. The system of claim 1, wherein the nozzle is vertically movable relative to the damp.

12. The system of claim 1, further comprising a metering pump operatively coupled to the nozzle and the supply of fluid material.

13. A method utilizing the system of claim 1, for at least partially filling a container with a fluid material, the method comprising:

securing the container in the clamp;

dispensing the fluid material into the container through the nozzle; and cutting the neck of the fluid material between the nozzle and the fluid material in the container.

14. The method of claim 13, wherein the dispensing includes inserting the nozzle into the container, introducing the fluid material into the container, and withdrawing the nozzle from the container during and/or after the introducing of the fluid material.

15. The method of claim 13, further comprising, between the dispensing and the cutting, thinning the neck by drawing back some of the fluid material through the nozzle.

16. The method of claim 13, wherein the fluid material is a shear thickening fluid material.

* * * * *